US005460564A

United States Patent [19]

Bowes et al.

[11] Patent Number: 5,460,564

[45] Date of Patent: Oct. 24, 1995

[54] SANDBLASTING CABINET ASSEMBLY

[75] Inventors: David M. Bowes, Kimberton; James R. Carlson, Pottstown, both of Pa.

[73] Assignee: Easthill Group, Inc., Frazer, Pa.

[21] Appl. No.: 958,871

[22] Filed: Oct. 8, 1992

[51] Int. Cl.[6] ..... B24C 9/00

[52] U.S. Cl. ..... 451/89; 312/263; 312/265.5

[58] Field of Search ..... 51/410, 424, 425, 51/426, 427, 319, 320, 321; 312/257.1, 263, 265.5

[56] References Cited

U.S. PATENT DOCUMENTS

| | | | |
|---|---|---|---|
| 744,405 | 11/1903 | Reno | 312/263 |
| 955,714 | 4/1910 | Steedman | 51/427 |
| 1,858,475 | 5/1932 | Wolever | 51/427 |
| 2,091,549 | 8/1937 | Kelso | 312/265.5 |
| 2,584,647 | 2/1952 | Webber | 51/426 |
| 2,730,420 | 1/1956 | Bruck | 312/257.1 |
| 3,300,902 | 1/1967 | Dockery | 51/426 |
| 3,516,205 | 6/1970 | Thomson | 51/426 |
| 3,858,360 | 1/1975 | Piet | 51/427 |
| 4,300,318 | 11/1981 | Brown | 51/319 |
| 4,579,400 | 4/1986 | French | 312/257.1 |

OTHER PUBLICATIONS

Snap–On Tools Catalog, p. 319.

TIP Sandblast Equipment 1991 Catalog, Code QC–2, pp. 15, 16, 17.

TIP Sandblas Equipment 1992 Spring/Summer Catalog, p. 35.

Hemmings Motor News, Aug. 1992, p. 6121.

*Primary Examiner*—Jack W. Lavinder

[57] ABSTRACT

A bench-top sandblasting cabinet has a useful work volume greater than about 8 cubic feet and is made from a collection of substantially planar panels assembled and matingly engaged with each other to form the cabinet and which can be nondestructively disassembled into substantially flat components, with the panels being connected at their edges.

3 Claims, 5 Drawing Sheets

SANDBLASTING CABINET ASSEMBLY

FIELD OF THE INVENTION

The present invention relates to a sandblasting cabinet assembly particularly designed for home use which in the preferred embodiment comprises a collection of prefabricated panels which are assembled by the consumer.

BACKGROUND OF THE INVENTION

Sandblasting is a well known operation wherein a stream of fluid, such as air or water, containing a suspended granular material is directed against a workpiece. The abrasive nature of the stream cleans or erodes the workpiece on which the stream is directed.

At first sandblasting was commonly performed using an air compressor and sand in a non-contained or open environment. Uncontained spraying of the sandblast medium had the effect of creating a "sandstorm" in the immediate area of the workpiece. Further, the granular or abrasive material was not recaptured and recycled, thereby adding to the inefficiency of the sandblasting process.

Recognizing these limitations, cabinets were developed to enclose the workpiece and to contain and recapture the sandblast medium.

For over 50 years, sandblast cabinets have been marketed towards industrial applications such as commercial automobile repair and restoration. Industrial-type cabinets are sold as preassembled units and often have welded seam construction. These cabinets are very large, to accommodate a wide variety of workpieces, and may cost from $600.00 to over $4,400.00 depending on their size. For example, Snap-On® Tools which is a registered trademark of Snap-On Tools Corporation, offers for sale (for $4,450.00) a cabinet which has 35 cubic feet of working area, which can handle a workpiece up to 15 inches×36 inches×36 inches and weighs 800 pounds. A cabinet such as this is overbuilt and overpriced for the home hobbyist.

Because of their size and permanent preassembled construction, prior art industrial sandblasting cabinets require shipping via commercial freight carrier. The high cost of preassembled, industrial cabinets in combination with the shipping cost makes these cabinets prohibitively expensive for the home market such as automobile repair and restoration hobbyists.

In an attempt to penetrate the home or "Do-It-Yourself" market, some prior art sandblasting cabinets were scaled down to a size which can be shipped via a light parcel delivery service such as the United Parcel Service (abbreviated herein as "UPS"). For example, Guyson FormJet, Inc. offers for sale, for $219.00, a bench-top sandblast cabinet which is shipped by UPS. This cabinet, however, has a very small work chamber, approximately 16 inches×22 inches×13 inches. Further, Guyson's cabinet is molded from clamshell-shaped, lightweight, plastic components and is promoted as a good "second" cabinet for sandblasting. This Guyson design is top heavy and can easily tip over when a heavy workpiece is loaded into the chamber. Tip Sandblasting Equipment offers for sale, for $299.00, a bench-top sandblast cabinet which is shipped by UPS. This cabinet, however, also has a small work chamber, approximately 18 inches×25 inches×18 inches.

The scaled-down cabinets offered by Guyson, Tip, and other manufacturers have not been well received in the marketplace because they are too small to accommodate many of the workpieces processed by, for example, an auto restoration hobbyist. While Tip Sandblast Equipment offers for sale a free-standing cabinet having a larger work chamber, approximately 19.5 inches×34 inches×25 inches, this cabinet must be shipped by commercial freight carrier and costs about $750.00. Thus, no cabinet is currently available which has a work chamber and an overall price both of which are well suited for the home hobbyist.

SUMMARY OF THE INVENTION

A first embodiment of the present invention comprises a bench-top sandblasting cabinet having a useful work volume greater than about 8 cubic feet. The cabinet has an overall width of about 34 inches, an overall length of about 24 inches, and an overall height of about 34 inches.

The cabinet comprises a collection of substantially planar panels which can be assembled and matingly engaged with each other to form the cabinet and which can be nondestructively disassembled into substantially flat components to facilitate easy shipment or movement of the disassembled cabinet. Each of the panels has girth and length, with a panel maximum dimension defined by girth plus length. In accordance with one object of the first embodiment, the disassembled collection of panels can be shipped inexpensively by UPS since the maximum dimension of each panel is less than UPS's maximum package dimension.

The panels are interconnected at their edges by joints. The joints comprise a flange, formed from the edge of a first panel, facingly contacting an edge of a second panel. Both the flange and the edge have a series of apertures which register with each other when the flange overlaps and facingly contacts the edge and the mating panels are properly aligned. A connecting pin is inserted through the properly registered apertures to lock the joint. The panels are prefabricated for easy assembly by the consumer using ordinary hand tools.

The present invention in the preferred embodiment provides a sandblasting cabinet assembly which is large enough, when assembled, to accommodate most common workpieces processed by auto restoration hobbyists, yet is small enough, when disassembled, to be shipped by a light parcel delivery service such as UPS. The cabinet assembly is sold unassembled and preferably is shipped by UPS in order to minimize the total cost to the consumer.

Because the maximum dimension of the container in which the assembly is shipped must be within UPS's package dimension limitations, in the preferred embodiment the maximum dimension of each of the panels is less than UPS's maximum package dimension; however, in order to maximize the interior workspace of the assembled cabinet, the maximum dimension of the largest panel is slightly less than UPS's maximum package dimension. Thus, while the package of individual cabinet assembly components is well within the package dimension limits set by UPS, in the preferred embodiment the assembled cabinet is large enough to accommodate a wide range of workpieces processed by the home auto restoration hobbyist.

In accordance with another embodiment of the present invention, a sandblasting cabinet has a useful work volume of about 27 cubic feet. The cabinet has an overall width of about 48 inches, an overall length of about 30 inches, and an overall height of about 73 inches. This large cabinet also comprises a collection of substantially planar panels which can be assembled and matingly engaged with each other to form the cabinet and can be nondestructively disassembled into substantially flat components. The panels of the larger cabinet have means for interconnecting the panels at their edges similar to the first, preferred embodiment.

Some of the panels according to this second embodiment are too large to be shipped via UPS and, therefore, must by shipped by commercial freight carrier. The additional shipping cost may be justified, however, by some consumers by the need for a larger useful work volume within the cabinet.

DETAILED DESCRIPTION OF THE PREFERRED EMBODIMENT

Figure 1:
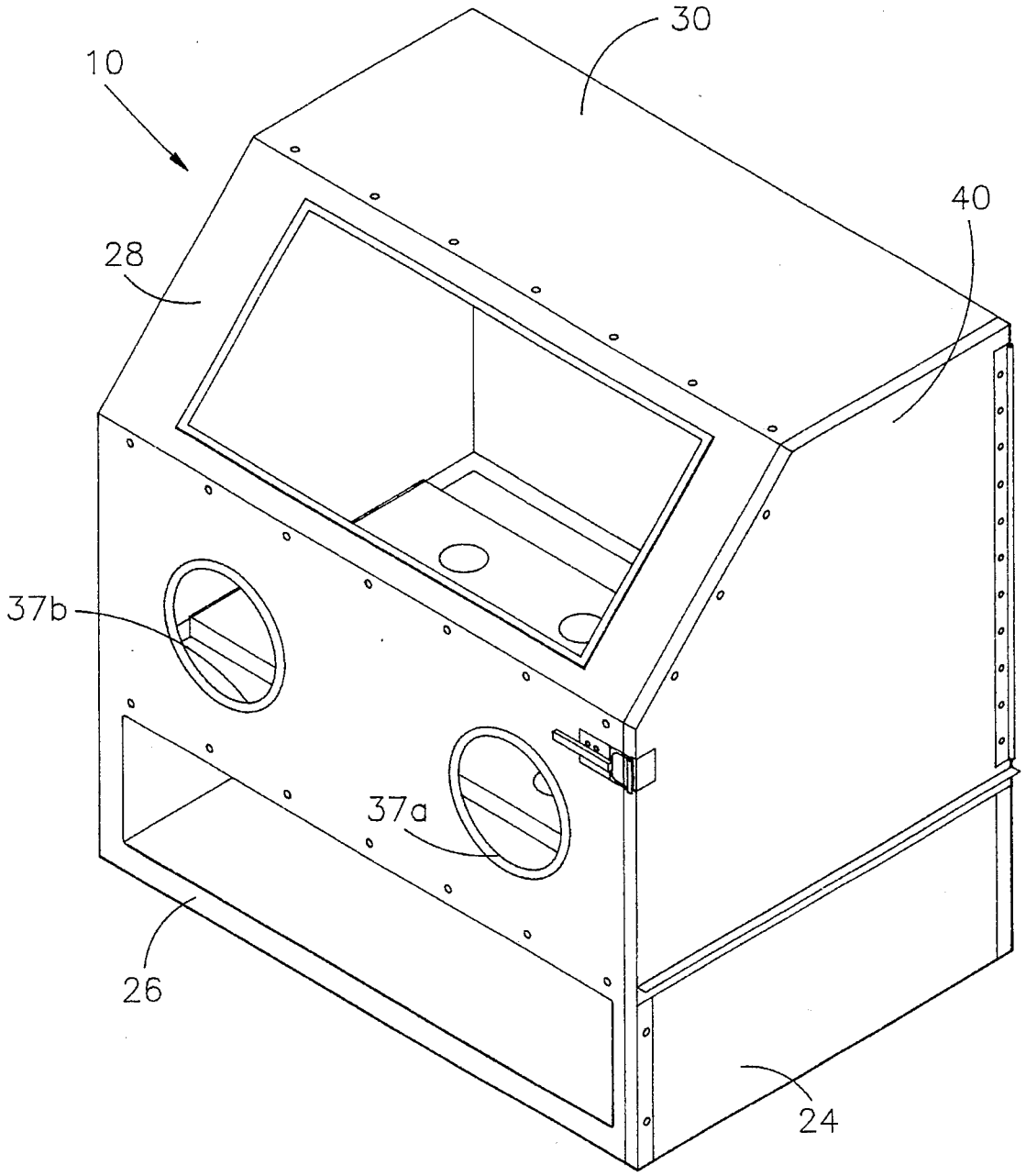
FIG. 1 is a perspective view of the preferred embodiment of an assembled sandblasting cabinet of the present invention.
Figure 2:
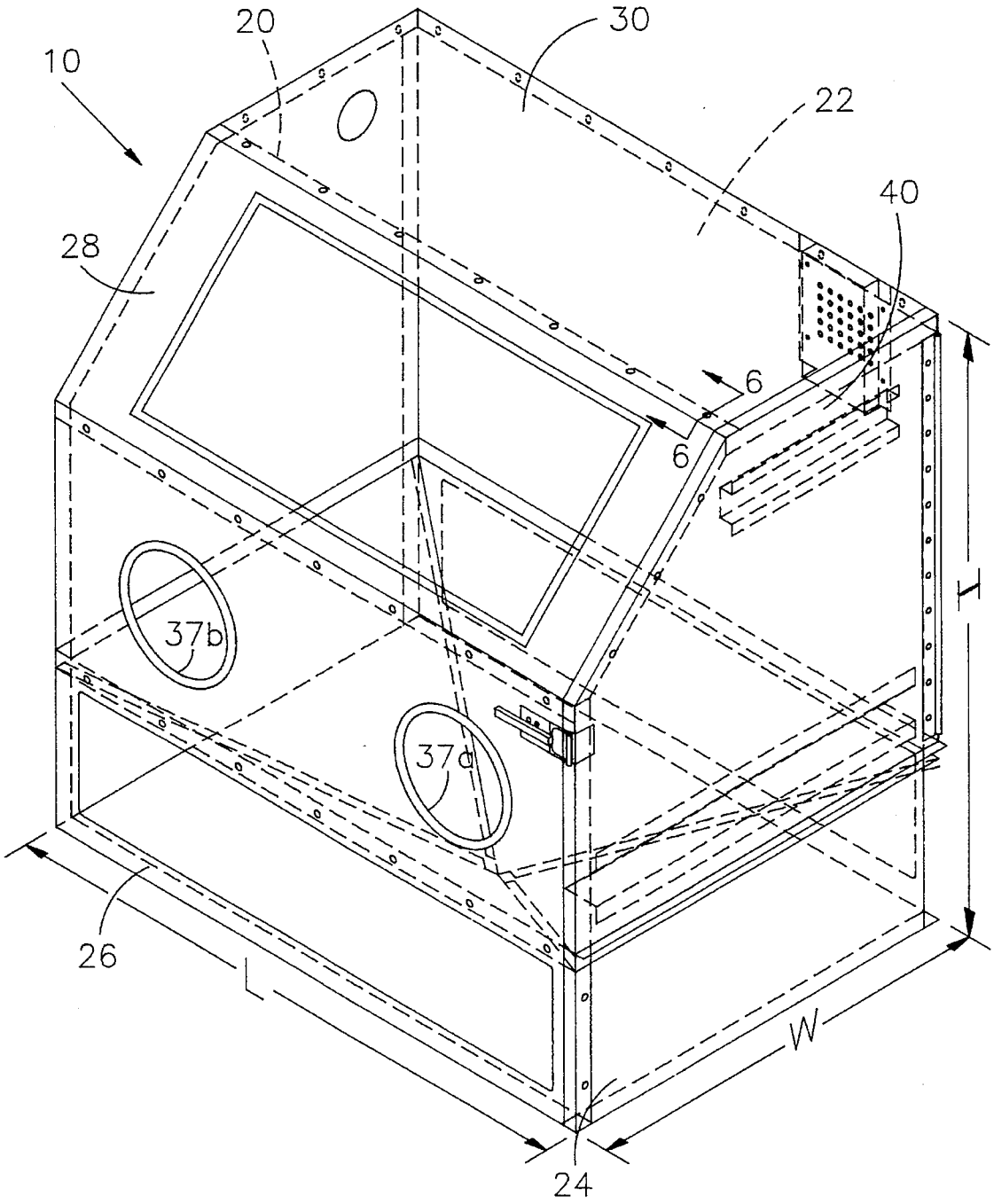
FIG. 2 is a perspective view of the cabinet of FIG. 1 showing the flanged joints of the cabinet in phantom.

Referring to FIG. 2., the cabinet of the present invention, designated generally by reference numeral 10, comprises a collection of substantially planar panels which form an enclosed cabinet for sandblasting, for example, auto parts for repair or restoration. The cabinet has an overall width, W, of about 24 inches, an overall height, H, of about 34 inches, and an overall length, L, of about 34 inches. The useful work volume within the cabinet is 24 inches deep×34 inches wide×a maximum height of 24.5 inches, or about 10.5 cubic feet.

Figure 3:
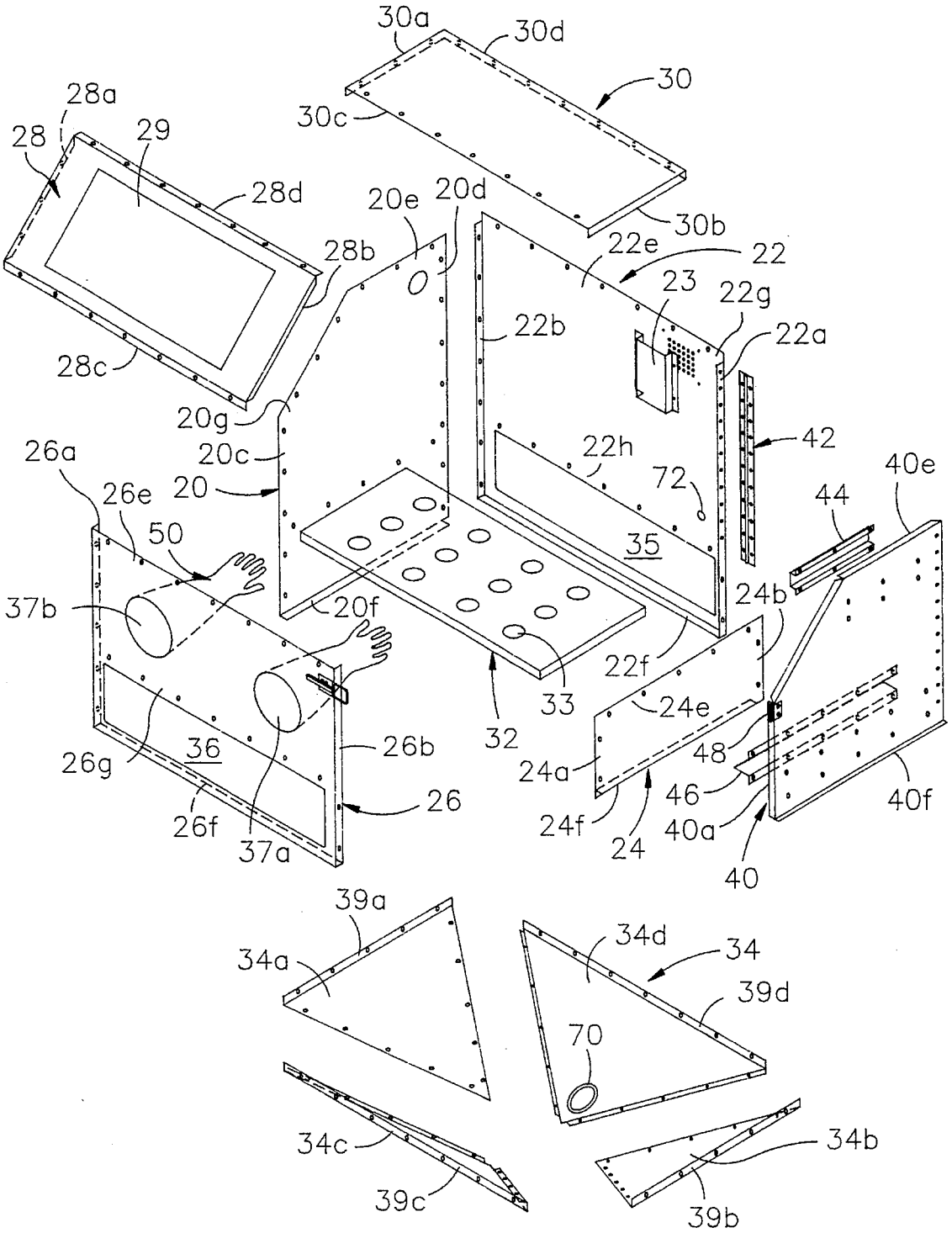
FIG. 3 is an exploded view of the individual panels defining the sandblasting cabinet shown in FIG. 1.

Referring to FIG. 3, the cabinet includes a left side panel 20, back panel 22, right side panel 24, front panel 26, top panel 30, bottom work panel 32, a window face panel 28, a door 40, and a hopper 34. Each panel is sold in a prefabricated condition, i.e. the flanges are perforated and formed, and the rivet holes are prepunched, before shipping. To assemble the cabinet, the consumer need only align and connect the panels.

Each of the panels has at least one flange which, unless otherwise indicated, extends generally along the full length of the edge and is generally perpendicular to the plane of the panel from which the flange is formed. The upper and lower flanges on the face panel and the flanges on the hopper panels, described hereinafter, extend along full length of the respective edges of those panels but are oblique to the planes of the those panels. Each of the flanges is about 1 inch wide as shown, for example, by the dimension "W" in FIG. 6, unless otherwise indicated.

Referring to FIG. 3 the back panel 22 is the largest panel in the collection, approximately 34 inches×34 inches, and has a vent baffle 23 in one of the upper corners. The back panel has a left flange 22*a*, left edge 22*g*, right flange 22*b*, bottom flange 22*f*, and top edge 22*e*. Each flange extends about the length of the panel and is about 1 inch in width. The back panel also has a cutout 35 about 31 inches wide by 7 inches high extending along the bottom portion of the back panel.

The right flange 22*b* and top edge 22*e* have a series of 7 apertures equally spaced about 5 inches from each other for connecting the left panel 20 and top panel 30. The left edge 22*g* has a series of 11 apertures equally spaced about 2 inches from each other for connecting the door hinge 42. A transverse series of 7 equally spaced apertures extends along the upper edge 22*h* of the cutout 35 for mounting the back hopper panel 34*d*. The left flange 22*a* has a series 11 of relief holes equally spaced 2 inches from each other which receive the rivet ends of the door hinge when the door is closed.

The front panel 26 has two circular ports 37*a* and 37*b* approximately 6.5 inches in diameter, each of which are fitted with glove-like flexible gauntlets 50 to provide sealed access to the workpiece. A workman can insert his hand into the gauntlets 50 and manipulate the workpiece while maintaining the integrity of the sealed sandblasting chamber.

The front panel is about 34 inches wide×24 inches high and has a left flange 26*a*, right flange 26*b*, bottom flange 26*f*, and top edge 26*e*. The left flange 26*a* has 5 apertures equally spaced about 5 inches from each other and the top edge 26*e* has 7 apertures equally spaced about 5 inches from each other. The right flange 26*b* has two apertures near the bottom and a cluster of 4 apertures in the upper right corner for affixing one piece of a latch 48. The front panel also has a cutout 36 about 31 inches wide by 7 inches high extending along the bottom portion of the front panel. A transverse series of 7 equally spaced apertures extends along the upper edge 26*g* of the cutout for mounting the front hopper panel 34*c*.

The slanted window face panel 28 is about 34 inches wide×14 inches high and has a large window cutout 29, about 24 inches×12 inches, to provide the workman good visibility into the cabinet while manipulating the workpiece. The cutout is covered when assembled with a tempered glass window having a window film to protect the glass from the sandblast medium.

Figure 6:
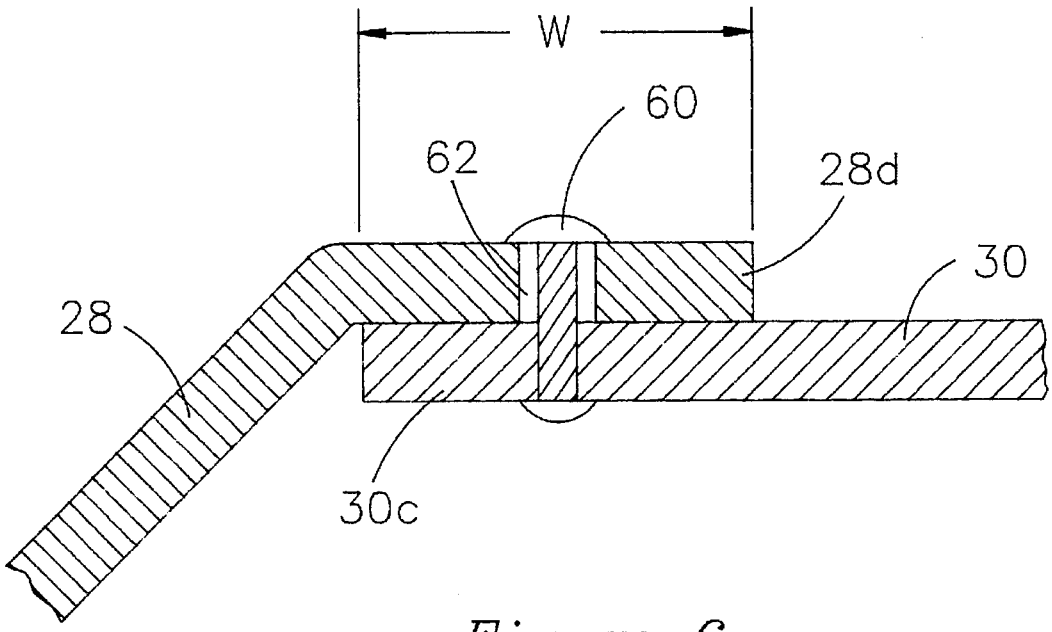
FIG. 6 is an enlarged fragmentary sectional view of one joint of the cabinet formed by the edge of one panel and the flange of another panel.

The face panel has four flanges 28*a–d* on each edge. The top and bottom flanges have 7 apertures and the left flange has 3 apertures. Each of the apertures along the flanges is equally spaced 5 inches from each other. The top flange, as seen in FIG. 6, and bottom flange are oblique to the plane of the face panel at about 45 degrees.

The left side panel 20 is approximately 24 inches wide×34 inches high. The front edge 20*c* has a series of 5 apertures for connecting the front panel 26; the back edge 20*d* has a series of 7 apertures for connecting back panel 22; the front slanted edge 20*g* has a series of 3 apertures for connecting the face panel 28; and, the top edge 20*e* has 3 apertures for connecting the top panel 30. The left panel 20 also has a series of 5 apertures extending widthwise across the left panel about 9.5 inches above the bottom of the panel for mounting the left hopper panel 34*a*. Each of the apertures in a series is equally spaced 5 inches from each other. The left panel 20 also has a flange 20*b* on the bottom edge.

The right side panel 24 is approximately 25 inches wide×10 inches high. The left 24*a* and right 24*b* edges have a pair of apertures spaced 5 inches from each other for connecting the front panel 26 and back panel 22, respectively. The top edge has a series of 5 apertures equally spaced 5 inches from each other for mounting the right hopper panel 34*b*.

The top panel is 34 inches wide×14 inches deep and has a flange on the left side 30*a*, right side 30*b*, and back side 30*d*. The left flange 30*a* has a series of three apertures for connecting the left panel 20; the back flange 30*d* has 7 apertures for connecting the back panel 22; and, the front edge 30*c* has 7 apertures for connecting the face panel 28. Apertures in a series are equally spaced 5 inches from each other.

The cutouts 36 and 37 in the front and back panels provide external access the hopper 34. The hopper 34 comprises four triangular panels 34*a–d*, which form an inverted pyramid underneath the bottom panel 32 which is about 34 inches×24 inches at the base and about 10 inches deep to the vertex. The sandblast medium falls through perforations 33 in bottom panel 32 onto the slanted hopper panels, and slides down into the vertex of the hopper.

Each panel 34*a–d* has a mounting flange 39*a–d* on one edge which flange is oblique to the plane of the hopper panel by about 53 degrees. The mounting flanges 39*a–d* are used to mount each of the four hopper panels to their respective mating panel as described above. The front 39*c* and back 39*d* mounting flanges each have 7 apertures equally spaced 5 inches from each other. The left 39*a* and right 39*b* mounting flanges each have 5 apertures equally spaced 5 inches from each other.

The front and back hopper panels have a flange on each of the other edges of the panel. Each flange has 5 apertures equally spaced 5 inches from each other. The left and right hopper panels have a corresponding series of apertures on the other edges of the left and right panels which overlap and connect with the mounting flanges 39*c* and 39*d*. Each edge has 5 apertures equally spaced 5 inches from each other. An occludable port 70 is provided in one of the hopper panels for draining or changing the sandblast medium inside the cabinet. The port is occluded with a plug or stopper.

The cabinet door 40 is located on the right side above the right side panel 24 and is about 24 inches wide×25 inches high. The door has 11 apertures equally spaced 2 inches from each other along the back side 40*d* for fixing the door to a hinge 42 which is fixed to the left side of the back panel 22. The door has an upper stiffener 44 and a lower stiffener 46 for added rigidity and stability. The door also has a latch strike 48 which cooperates with a latch on the front panel to lock the door to the front panel.

While manipulating the workpiece during sandblasting, the workpiece may be intermittently supported on the bottom work panel 32 which is perforated to prevent accumulation of sandblast medium on the bottom panel. The bottom work panel 32 is preferably made from expanded metal. The sandblast medium falls through the perforations 33 and is collected in the hopper 34 beneath the bottom panel 32.

Once sandblasting has commenced, the cabinet is normally not opened until the workpiece has been completely cleaned since the sandblast medium is circulated within a closed system. The sandblasting gun is connected to an air hose which feeds through a port 72 to a source of high pressure air located outside the cabinet. The sandblasting gun is also connected to a hose which siphons sandblast medium from the hopper. The sandblast medium sprayed from the gun falls down into the hopper, continuously replacing the supply.

Rust, dirt or paint which was on the workpiece is drawn out of the system through a port in the cabinet by a vacuum source. Some of the dirt, however, falls down into the hopper and mixes with the sandblast medium. Eventually the sandblast medium becomes too contaminated and requires replacement. The medium can be drained through the port 70 at the bottom of the hopper and replaced with new medium.

Figure 5:
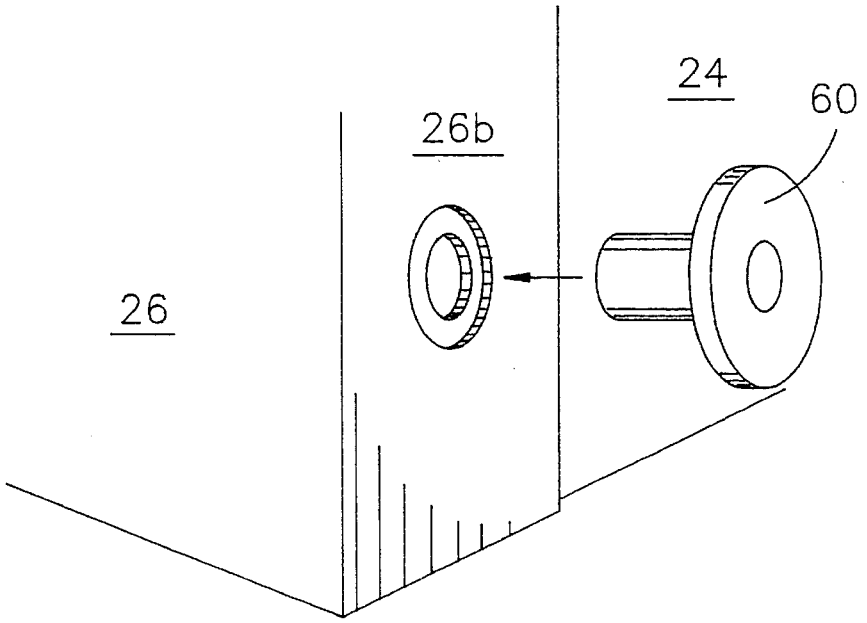
FIG. 5 is an exploded, enlarged, fragmentary isometric view showing the manner in which a rivet connects a flange of a first panel overlapping a surface of a second panel, thereby connecting the two panels.

The panels are preferably made of 18 gauge galvanized steel. As best illustrated in FIG. 3, the panels have flanges at their edges for interconnecting the panels to form the cabinet. The flanges are perforated with a series of holes which register with a corresponding series of holes on another panel when the panels are properly, matingly engaged. One of the holes of a registered pair is larger than the other to assist in registering the holes during assembly as seen in FIG. 5. The diameters of the smaller and larger holes are about 0.187 and 0.375 inches, respectively. The shaft portions of the rivets which secure the panels together are slightly smaller diameter than the smaller holes, while the head portions of the rivets are larger diameter than the larger holes.

Since the panels are prefabricated, the cabinet can be easily assembled with a rivet gun and screwdriver in about one hour. Alternatively, the panels may be secured together by nuts and bolts.

As previously mentioned an object of a preferred embodiment of the present invention is to utilize UPS to ship the unassembled collection of panels to the purchase. UPS is recognized as one of the most reliable and moderately priced light parcel shipping service in the United States. For example the current cost for shipping a 50 pound package by regular ground service (5–6 days delivery time) from Pennsylvania to Ohio is about $10.00; to Kansas is about $16.00; and, to California is about $23.50. However, UPS dictates the maximum size package which it will accept for delivery. According to UPS guidelines, the maximum package dimension, defined as the sum of the package girth plus length, cannot exceed 130 inches. Additionally, no single dimension of the package, such as length or height, may exceed 108 inches. Further, no package can weigh more than 70 pounds.

Figure 4:
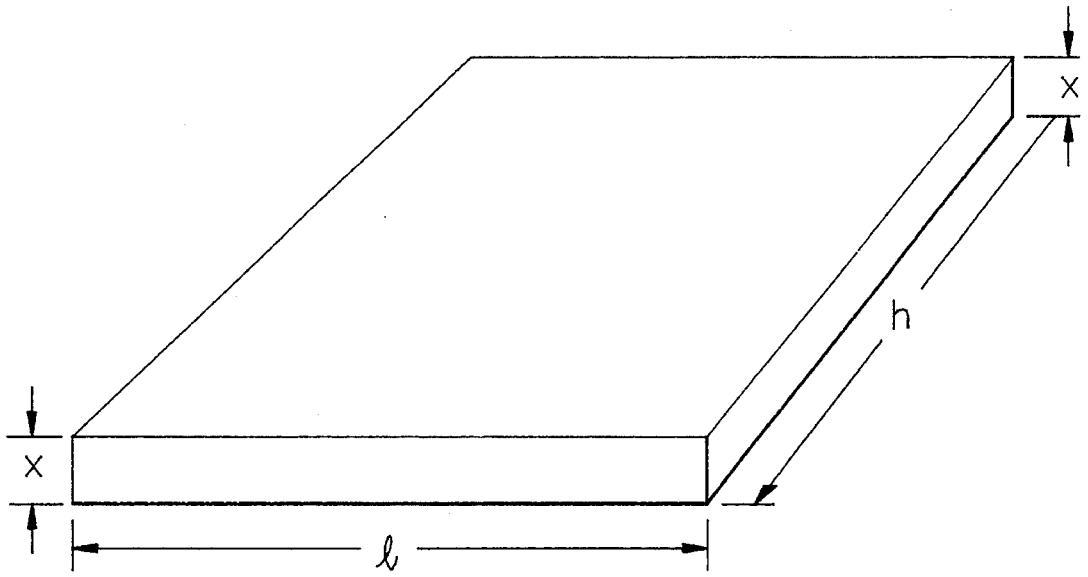
FIG. 4 is a perspective view of one of the preferred shipping containers containing the largest unassembled panels of a sandblast cabinet according to the invention.

The back panel of the preferred embodiment of the present invention is the largest panel in the collection, approximately 34 inches×34 inches. Since each of the panels and other components of the present invention is substantially flat, an optimum container for shipping the larger panels is shown in FIG. 4. Because the back panel is rigid, the package shown in FIG. 4 optimizes the package size in which the panels may be shipped. The dimensions "l" and "h" correspond to the dimensions of the back panel and of the assembled cabinet-as shown in FIG. 3. If "l" is less than "h" the maximum dimension of the package shown in FIG. 4 is equal to [(2l+2x)+h]. If "h" is less than "l", the maximum dimension of the package is equal to [(2h+2x)+l]. In the preferred embodiment, "l" and "h" are each approximately 34 inches. Thus, the thickness or depth of the package, "x" may be up to about 3 inches, which is deep enough to accommodate the panels if they are stacked flatly on each other. Alternatively, the back panel may have a rectangular shape in which case the perimeter of the back panel should be less than or equal to about 102 inches in order to maintain a package depth of about 3 inches for stacking the panels.

Assembly of the panels requires a screw driver and a rivet gun and can be accomplished in about one hour. To insure proper assembly, the panels should be pre-fitted before riveting since some of the panels may appear to mate with more than one other panel. The series of holes in the flange of each joint has a different diameter than the series holes in the panel with which they mate as seen in FIG. 5, which shows one pair of registered holes. The component, either the flange or the edge of the panel, which is intended to form the outside (relative to the sandblast cabinet exterior) of the joint has a larger hole for easier alignment of the holes. For example, since the flange 26*b* on the front panel 26 is riveted on the outside of the right side panel 24, the hole in the flange 26*b* is larger.

Figure 7:
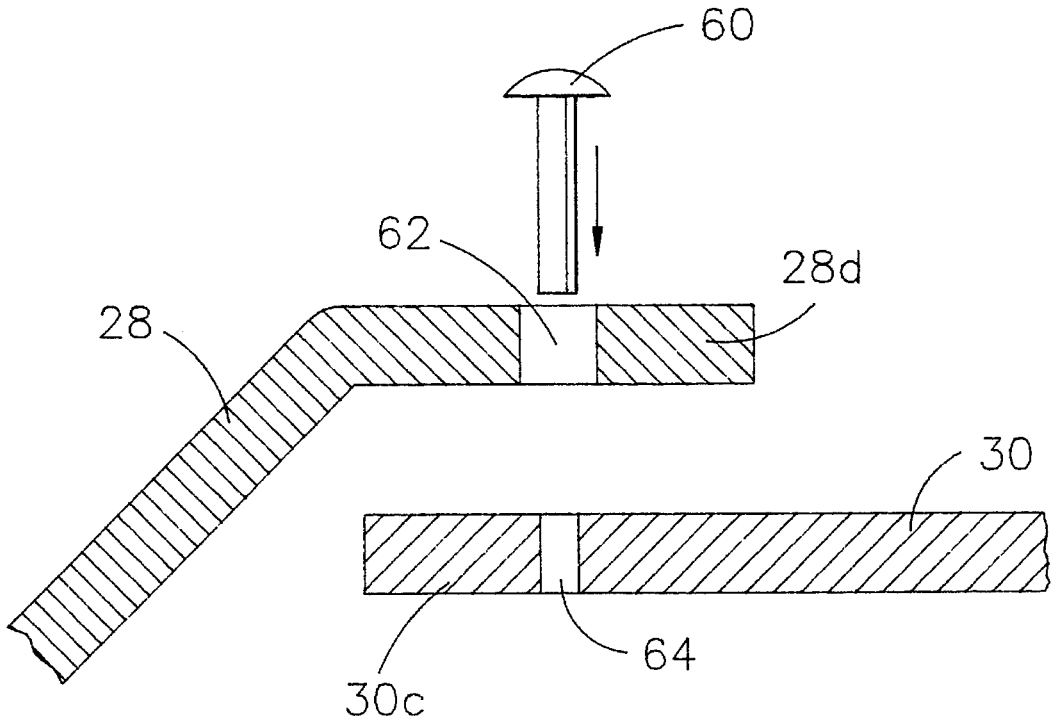
FIG. 7 is an exploded view of the riveted flange-edge joint shown in FIG. 6.

When properly connected the panels form an overlapping joint comprising a flange from one panel and the edge of another panel. As seen in FIGS. 6 and 7, the flange 28*d* from the face plate overlaps and is riveted to the edge 30*c* of the top panel 30 to form a good seal between the panels. The rivets 60 are inserted, as shown by the arrow, through the larger, outer hole 62 first and then through the smaller inner hole 64. The larger hole in the outer panels is provided to compensate for slight misalignment of the apertures and facilitates registry of the apertures.

The panels are assembled preferably in the following sequence of steps wherein, in most cases as illustrated in the drawings, each flange preferably overlaps the exterior surface of the adjoining panel to which the flange is to be connected, unless otherwise indicated. Likewise and resultantly, the heads of the rivets are on the exterior of the sandblast cabinet, after the cabinet is assembled. Referring to FIG. 3, the back edge 20*d* of the left side panel 20 is riveted to the inside of the right (as seen from the outside) flange 22*b* of the back panel 22; the front edge 20*c* is then rivetted to the inside of the left flange 26*a* on the front panel 26. The front edge 24*c* edge of the right panel 24 is riveted to the inside of the right flange 26*b* on the front panel. The back edge 24*d* of the right panel is then riveted to the inside of the left (as seen from the outside) flange 22*a* of the back panel 22.

To assemble the hopper, mounting flanges of the front hopper panel 34*c* and the back hopper panel 34*d* are riveted to the inside of the front panel 26 and back panel 22 respectively, with the flange sections of the hopper panels facing upwardly. The mounting flanges of the left 34*a* and right 34*b* side hopper panels are riveted to the inside of the left panel 20 and right panel 24, respectively, and to the inside of the other flanges on the front 34*c* and back 34*d* hopper.

The bottom flange 28*c* of the face panel 28 is riveted behind the top edge 26*e* of the front panel. The left flange 28*a* is riveted to the outside of the edge 20*g* of the left panel 20. The top panel 30 is riveted to the cabinet with the front edge 30*c* on the inside of the top flange 28*d* of the face plate 28. The left flange 30*a* and back flange 30*d* of the top panel 30 are riveted to the outside of the top edge 20*e* of the left side panel 20 and the top edge 22*e* of the back panel 22 respectively.

A vent baffle 23 is riveted to the inside, upper right corner of the back panel 22. Upper 44 and lower 46 stiffeners are riveted to the inside of the door 40. The door 40 is then attached to the cabinet by a hinge 42 which is riveted to the outside of the left edge 22*g* of the back panel 22 and to the outside of the back edge 40*d* of the door 40. A latch 48 is riveted to the outside of the front edge 40*c* of the door 40 and the right edge 26*h* of the front panel 26.

The open end of a glove-like gauntlet 50 is positioned in the left 37*a* and right 37*b* ports of the front panel 26 and sealed therein with a retaining strip. Seals are placed around the window hole on the face plate 28 and around the flanges 27*a*, 30*b*, 28*b*, and 26*b* on the panels defining the door opening. A piece of tempered glass is secured over the window hole using a window frame which is fastened to the face plates. The perforated floor panel 32 is placed in the interior of the cabinet and allowed rest on the inwardly protruding bottom flanges 26*f*, 20*f*, and 22*f* of the front, left and back panels, respectively. Finally, the interior seams and joints of the cabinet are sealed using a seam sealer.

For convenience a light fixture may be installed on the top panel of the cabinet. A cutout can be taken from the top panel and covered with a transparent material such as a plate of tempered glass. A light fixture may then by mounted on the outside of the top panel above the glass plate to illuminate the interior of the cabinet without interfering with the workpiece.

In another embodiment of the present invention, a larger capacity sandblasting cabinet is provided which is also assembled from a collection of substantially planar panels as described above. The larger cabinet has a useful work volume of about 27.3 cubic feet and has an overall length of about 48 inches, overall depth of about 31 inches, and an overall height of about 73 inches. While this embodiment provides a cabinet which can be assembled and nondestructively disassembled into its component panels, the largest panels of this embodiment are too large to be shipped UPS. However, the cabinet is more easily transported disassembled than assembled, which provides added convenience for the home hobbyist.

While the preferred embodiment of the invention has been described above and alternative embodiments have also been described, the scope of protection to which the invention is believed entitled is defined by the claims and by equivalents thereto which perform substantially the same function in substantially the same way to achieve substantially the same result as set forth in the claims, so long as such substantial equivalents, as defined by a claim specifically for such substantial equivalent, do not read on the prior art.

We claim:

1. A benchtop sandblasting cabinet, comprising:

a. a plurality of substantially planar panels which are assembled and matingly engaged with each other to form said cabinet, and which can be nondestructively disassembled into substantially flat panels for shipment to a second site for reassembly thereat; and b. means for interconnecting said panels at their edges, said interconnecting means comprising:

i. a flange, formed from an edge of a first panel to be connected to a second panel, by bending said edge substantially transversely to an adjoining, non-edge portion of said panel, being adapted for facing contact with said second panel, said flange having a first series of apertures formed therethrough extending the length of said flange parallel with and along said panel edge;

ii. an edge of a second panel having a second series of apertures registering with apertures in said flange when said flange overlaps and facingly contacts said second panel edge and said panels are properly aligned for assembly as a portion of said cabinet, said second series of apertures being of lesser diameter than said first series; and iii. a rivet, having a shaft portion and having a head portion of larger diameter than said apertures of said first series, inserted into a pair of said properly aligned apertures with said head portion facingly contacting a surface of said flange oppositely facing from a flange surface which facingly contacts said second panel, with said rivet having an extremity of said shaft portion opposite said head portion deformed against a surface of said second panel which faces oppositely from a second panel surface which facingly contacts said flange.

2. A sandblasting cabinet having useful work volume of about 27 cubic feet, overall width of about 48 inches, overall length about 30 inches, and overall height of about 73 inches, comprising:

a. a plurality of substantially planar panels assembled and matingly engaged with each other to form said cabinet;

b. means for interconnecting said panels at their edges, comprising a plurality of joints connecting said panels, each of said joints comprising:

i. flanges formed at edges of first panels, said flanges having first series of apertures;

ii. edges of second panels having second series of apertures;

iii. apertures in said first series registering with apertures of said second series when one of said flanges overlaps one of said apertured edge and said panels are aligned; and, iv. rivet pins in said registering apertures;

c. a face panel having at least one flange oblique to the panel surface and at least one flange perpendicular to the panel surface.

3. A bench-top sandblasting cabinet having useful work volume greater than about 8 cubic feet, comprising:

a. a plurality of substantially planar panels assembled and matingly engaged with each other to form said cabinet;

b. means for interconnecting said panels at their edges, comprising a plurality of joints connecting said panels, each of said joints comprising:

i. flanges formed at edges of first panels, said flanges having a first series of apertures;

ii. edges of second panels, said panels having second series of apertures;

iii. apertures in said first series registering with apertures in said second series when one of said flanges overlaps said edge and said panels are aligned;

iv. connecting pins in said aligned apertures; each panel having girth and length, a maximum dimension equal to girth plus length, and said maximum dimension of at least one panel being slightly less than 108 inches;

c. a face panel having at least one flange oblique to face panel surface and at least one flange perpendicular to the face panel surface.

* * * * *